US006093049A

United States Patent [19]

Daoud

[11] Patent Number: 6,093,049

[45] Date of Patent: Jul. 25, 2000

[54] WIRE INSERTION ENTRANCE APERTURE

[75] Inventor: Bassel H. Daoud, Parsippany, N.J.

[73] Assignee: Lucent Technologies Inc., Murray Hill, N.J.

[21] Appl. No.: 09/218,059

[22] Filed: Dec. 21, 1998

[51] Int. Cl.[7] ..... H01R 4/24

[52] U.S. Cl. ..... 439/409

[58] Field of Search ..... 439/409, 410, 439/417

[56] References Cited

U.S. PATENT DOCUMENTS 3,611,264 10/1971 Ellis .
4,662,699 5/1987 Vachhani et al. .
4,793,823 12/1988 Cozzens et al. ..... 439/409
5,240,432 8/1993 Daoud .
5,637,011 6/1997 Meyerhoefer et al. ..... 439/409
5,860,829 1/1999 Hower et al. ..... 439/419

*Primary Examiner*—Khiem Nguyen
*Assistant Examiner*—J. F. Duverne

[57] ABSTRACT

A tool-less insulation displacement connector comprising a housing having an upper portion in which a wire insertion hole having a longitudinal axis is formed, the upper portion having a front face through which the axis extends; and an entrance aperture formed in the front face, the entrance aperture being in fluid communication with the hole, the front face having a generally flat planar surface, the surface plane of the front face intersecting the axis at a non-perpendicular angle.

23 Claims, 9 Drawing Sheets

WIRE INSERTION ENTRANCE APERTURE

FIELD OF THE INVENTION

This invention relates to an Insulation Displacement Connector, and in particular, to a connector having an improved wire insertion hole aperture.

BACKGROUND OF INVENTION

In a telephone network, a network cable from the central office is connected to a building entrance protector (BEP) located at the customer site, where the individual telephone lines are broken out line by line. The network cable, which consist of a plurality of tip-ring wire pairs that each represent a telephone line, is typically connected to a connector block that is an integral part of the BEP. Such connectors may be, for example, the ubiquitous 66-type punch down connector, or an SC 99 type connector block, such as are available from Lucent Technologies Inc., or the mini rocker tool-less insulation displacement (IDC) type connector, such as for example those sold by A. C. Egerton, Ltd. Other connectors used for telephony wiring applications are described in U.S. Pat. No. 4,662,699 to Vachhani et al., dated May 5, 1987, and in U.S. Pat. No. 3,611,264 to Ellis, dated Oct. 5, 1971.

A mini-rocker connector generally has a movable top section which comprises two generally tapered, funnel-shaped wire insertion holes and a lower fixed section which houses a pair of terminal strips. The terminal strips have a wire engaging portion at one end for engaging and making electrical contact with a wire. The terminal strips are generally parallel to one another but offset to provide a sufficient dielectric strength between them. In order to make the connector as small as possible, as a matter of design choice, the terminal strips are moved as close together as possible while maintaining good dielectric strength.

The top movable section of the connector pivots about a fixed axis located towards the back side of the connector. The top section has a movable latch member to maintain the top section in its closed position. To open the top section, a user releases the latch member and pivots the top section to its open position. When the top section is open, the terminal strips do not intersect the wire insertion holes, and when the top section is closed, the terminal strips intersect the wire insertion holes. In order to establish an electrical connection between the wires and the terminal strips a user first opens the top section, i.e., pivots the top section to its open position, inserts the pair of wires, and then closes the top section. Upon closing the top section of the connector, the wires are forced through the terminal strip engaging portion to make electrical and mechanical contact with the terminal strips. To remove the wires and/or break the electrical connection, the process is reversed.

The prior art connector is designed such that the top section pivots upwards an amount such that the entrance apertures and wire insertion holes becomes more visible. One of skill in the art will recognize that the more visible the entrance aperture, the less time it takes for a user to perform the required task. The visibility is evaluated by the size the entrance apertures appears to a user in a typical installation. When the top section of the prior art connector is in its closed position, the entrance apertures appear as flat ovals and are thus perceived as smaller than they really are.

Were the wire insertion holes to be moved closer together, the entrance apertures would have to be made smaller or made to overlap, which would result in even greater difficulty in wiring the connector and hence a longer wiring time by the user or technician. In the prior art connector the front face of the connector in which the entrance apertures are formed is flat or perpendicular to the direction of the wire insertion holes. Thus, when viewed from the side, the prior art entrance aperture forms a trapezoid, with the front and back planes being substantially parallel to one another. One of skill in the art will recognize that the size of the prior art connector cannot be easily reduced without the undesired result of having the entrance apertures overlap. Also, the visibility of the prior art entrance apertures is limited by the degree of pivot of the connector top section. The present invention is directed at overcoming shortcomings of the prior art connectors.

SUMMARY OF THE INVENTION

Generally speaking, in accordance with the instant invention, the circular entrance apertures of the connector are angled, resulting in an entrance aperture that is perceived as a larger oval than the prior art openings. Constructed as such, the wire insertion holes can be moved closer together without the need for overlapping the entrance apertures, thus permitting construction of a smaller connector. Furthermore, by angling the front face of the entrance aperture, the visibility of the entrance apertures is increased both when the top section is in its closed position and when the top section is in its open position.

In a preferred embodiment, the connector generally has a top section, movable between an open position and a closed position, and a bottom fixed section. The top movable section generally pivots about a fixed axis for a fixed distance. The top section has a latch member movable between an engaged position and a disengaged position. When the top section is in its closed position and the latch member is in its engaged position, the latch engages a corresponding retention member on the bottom section of the connector. Thus, when the top section is in its closed position and the latch member is in its engaged position the latch member maintains the top section in its closed position.

The connector of the present invention is constructed such that the front face of the connector in which the sloped entrance apertures are formed is angled backward at about a 15° angle. Thus, when viewed from the side, the entrance aperture of the present invention preferably forms, when seen in cross-section, a trapezium-shaped quadrilateral. That is, no two sides of the entrance aperture of the present invention are parallel. When the top section of the connector of the present invention is in its open position, the entrance apertures appear as large ovals and are thus more visible to a user. Also, by angling the front face of the connector, the wire insertion holes can be moved closer together without having to overlap the entrance apertures, while good visibility is maintained.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DESCRIPTION OF A PREFERRED EMBODIMENT

Generally speaking, in accordance the instant invention, a connector is provided having angled front face entrance apertures.

Figure 1:
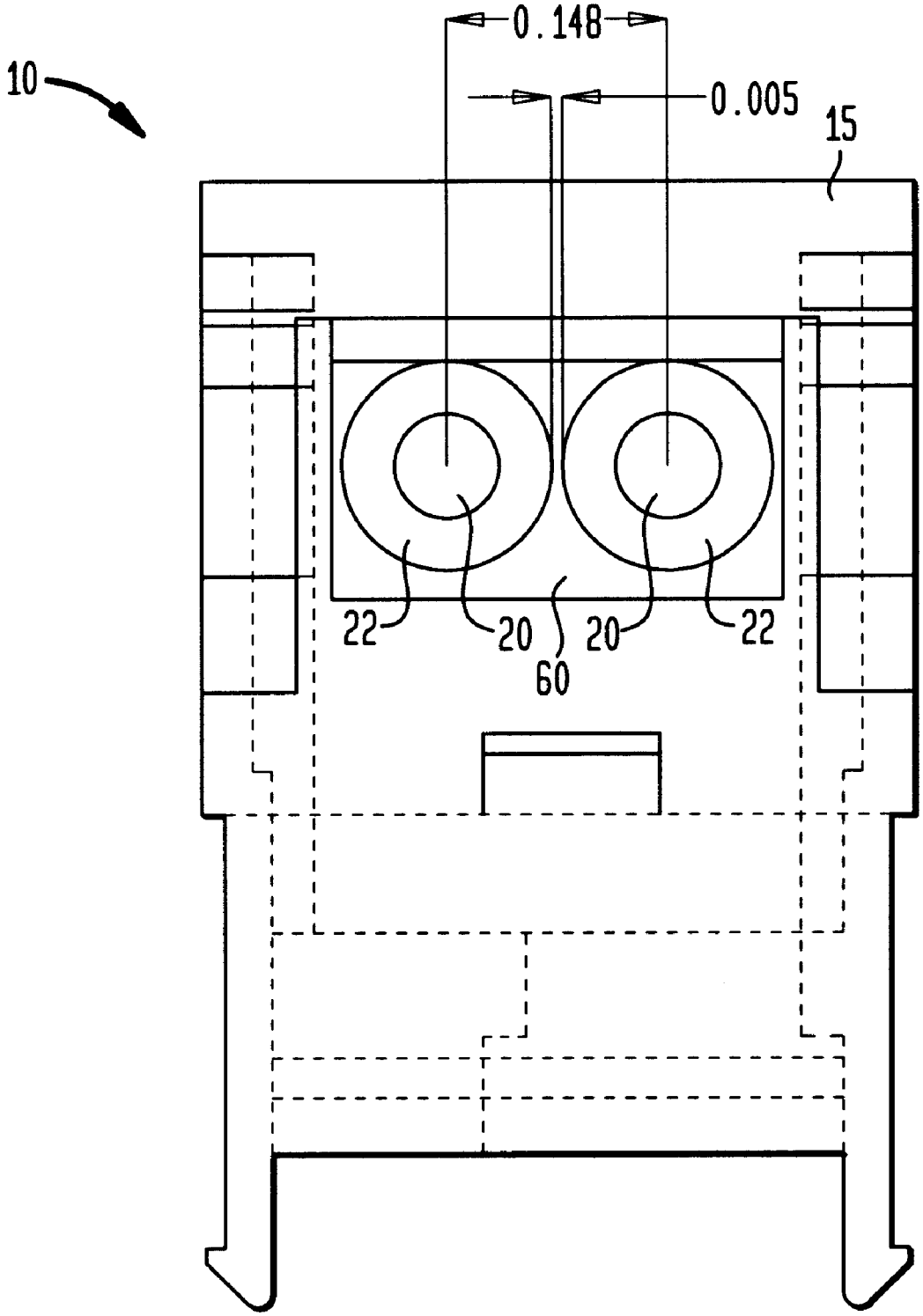
FIG. 1 (PRIOR ART)
FIG. 1 is a front elevational view of a connector constructed in accordance with the prior art with the top section in its closed and locked position.

As seen in FIGS. 1–6, a prior art connector, generally indicated as 10, has a top section, generally indicated as 12, movable between an open position (FIG. 3) and a closed position (FIG. 2), and a bottom fixed section, generally indicated as 14. Connector 10 generally comprises two generally funnel-shaped, conical entrance apertures 22 formed in front face 60 which lead in tapered fashion to wire insertion holes 20. As seen in FIG. 1, the centers of wire insertion holes 20 are about 0.148 inches apart, and there is about a 0.005 inch gap between the entrance apertures 22. Thus, wire insertion holes 20 can not easily be moved closer together without having the undesired result of having the entrance apertures 22 overlap. Each wire insertion hole 20 is constructed so as to accept a wire 30 of a type well known in telephony. Connector 10 also has terminal strip receiving portions 26, which are constructed to receive terminal strips 28 when the top section 12 is in its closed position.

Figure 2:
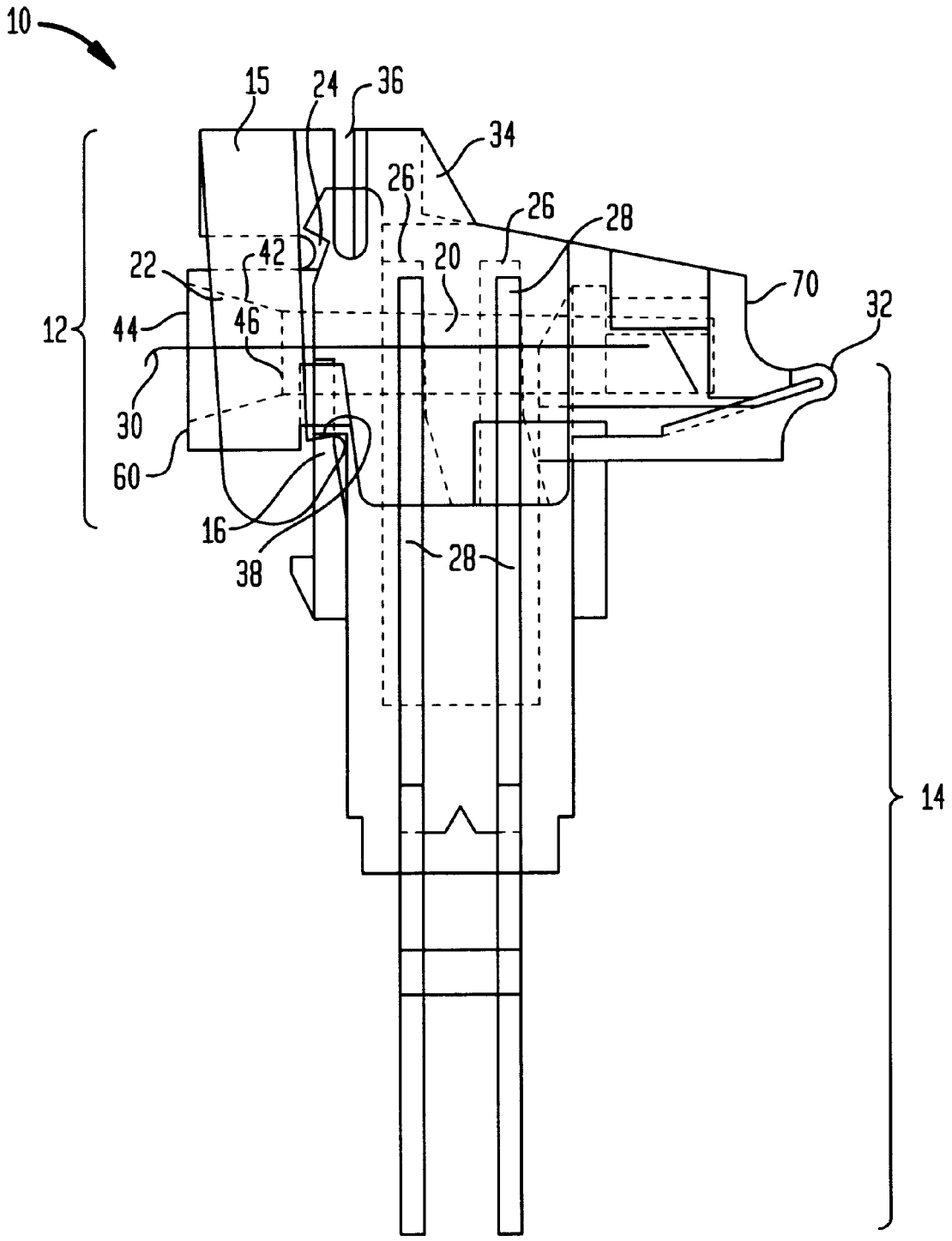
FIG. 2 (PRIOR ART)
FIG. 2 is a side elevational view of the prior art connector of FIG. 1.

As seen in FIG. 2, when top section 12 is in its closed position, terminal strips 28 intersect wire insertion holes 20, and when top section 12 is in its open position (FIG. 3), terminal strips 28 do not intersect wire insertion holes 20. In order to establish an electrical and mechanical connection between the wires 30 and the terminal strips 28, a user first opens the top section 12, i.e., pivots top section 12 about hinged axis 32 to its open position, inserts a pair of wires 30, and then closes the top section 12. Upon closing top section 12 of connector 10, wires 30 are brought into electrical and mechanical contact with terminal strips 28 in a manner known in the art. To remove the wires and/or break the electrical connection, the process is reversed.

Figure 3:
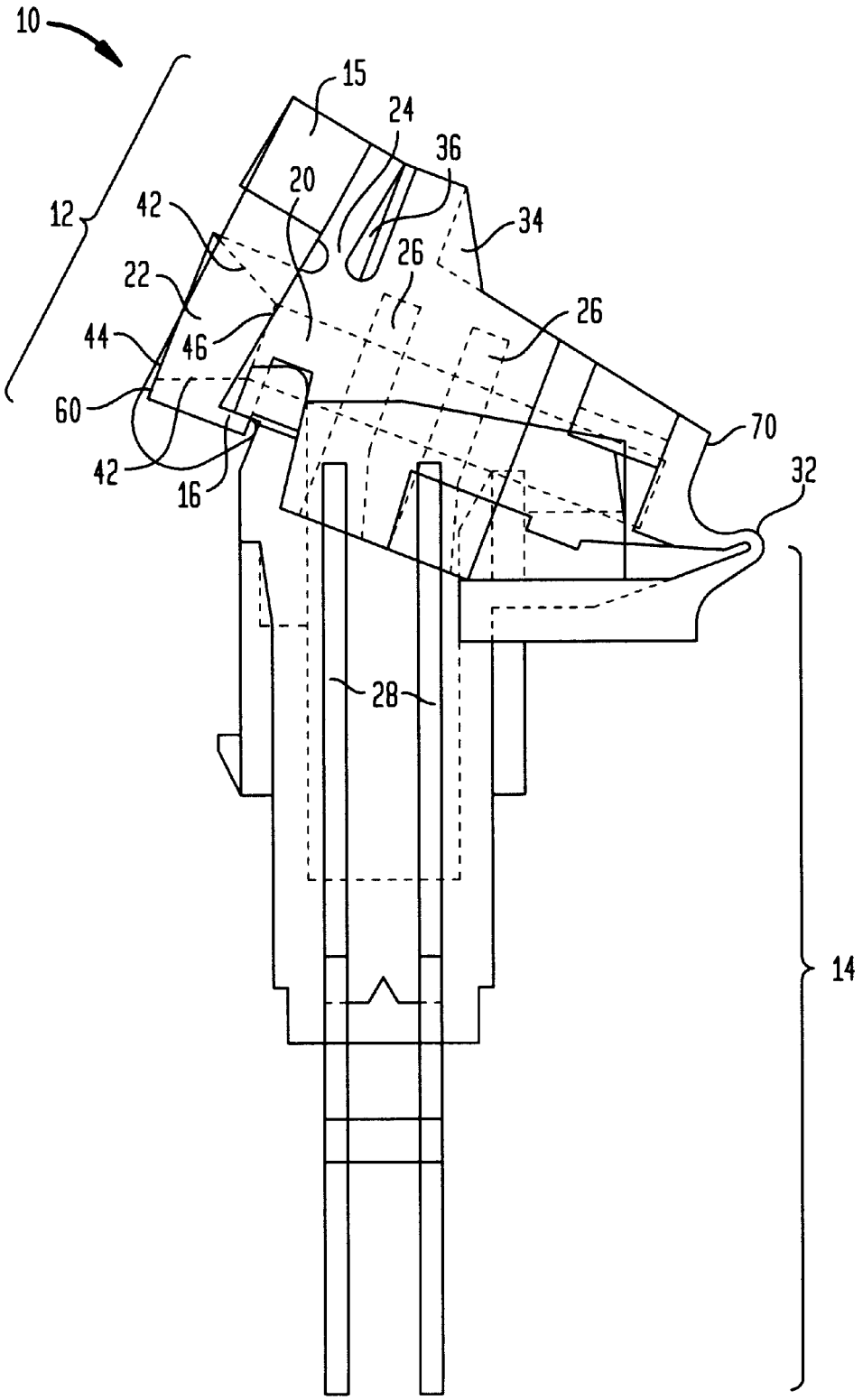
FIG. 3 (PRIOR ART)
FIG. 3 is a side elevational view of the prior art connector of FIG. 1 with the top section in its open position.

As seen in FIG. 3, the top movable section 12 generally pivots about a fixed axis at hinge 32. The top section has a latch 15 movable between an engaged position and a disengaged position. As seen in FIG. 2, when top section 12 is in its closed position and the latch 15 is in its engaged position, latch engaging portion 16 engages latch retaining portion 38 on the bottom section 14 of the connector 10. Thus, when the top section 12 is in its closed position and the latch is in its engaged position, the latch 15 maintains top section 12 in its closed position. In order to open top section 12, latch 15 must first be moved to its disengaged position.

To move latch 15 between its engaged position and its disengaged position, a user generally grips the connector between a finger grip portion 34 and top portion of the latch 15. Upon squeezing or other pressure, latch 15 pivots about living hinge 24 towards recess 36. Latch 15 is pivoted about living hinge 24 into recess 36 a sufficient distance so as to disengage latch engaging portion 16 from latch retaining portion 38. Once latch engaging portion 16 is disengaged from latch retaining portion 38, top section 12 is able to move to its open position.

Figure 4:
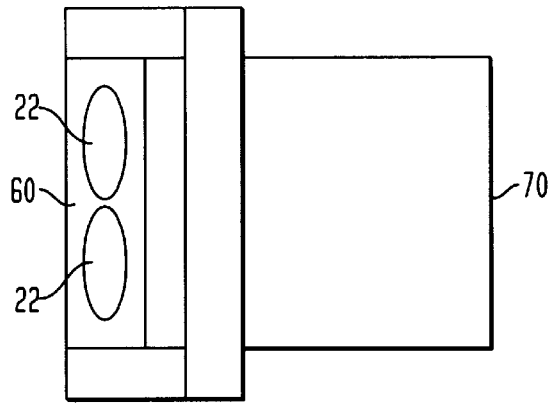
FIG. 4 (PRIOR ART)
FIG. 4 is a top plan view of the prior art connector of FIG. 3.

As seen in FIG. 4, connector 10 is generally installed in a BEP (not shown) in a horizontal position. Thus, when the prior art connector is in its closed position, the perceived visibility of the entrance apertures 22 is near zero, and when the prior art connector is in its open position, the entrance apertures 22 become somewhat visible as a flat ovoid. The construction of the prior art entrance apertures is shown in more detail in FIGS. 5 and 6.

Figure 5:
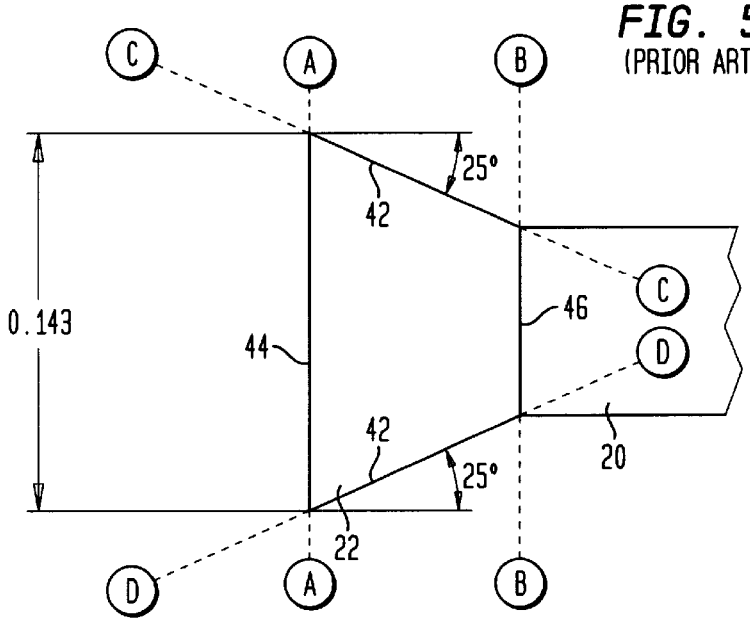
FIG. 5 (PRIOR ART)
FIG. 5 is an enlarged partial side elevational view of the entrance aperture and wire insertion hole of a prior art connector with the top section in its closed position.

FIG. 5 depicts a side view of a prior art entrance aperture of a connector, with the top section of the connector in its closed position. The entrance aperture 22 comprises an entrance opening 44, an exit opening 46, and side walls 42 extending between the two openings. When viewed from the side in section, the entrance opening 44 forms a plane A, the exit opening 46 forms a plane B, and side walls 42 form planes C and D. Thus, the prior art entrance aperture, when seen in sectional side view, forms a trapezoid, with two sides, i.e., the front plane A and back plane B, being parallel to one another. As seen in FIG. 5, by way of a non-limiting example, the width or diameter of entrance aperture 22 is 0.143 inches. The side walls 42 of entrance aperture 22 are beveled at a 25° angle towards wire insertion hole 20. One of skill in the art will recognize that when viewed from above, as in a typical installation, entrance aperture 22 cannot be seen when the top section of the connector is in its closed position. That is, the perceived visibility of the entrance apertures is considered to be zero.

Figure 6:
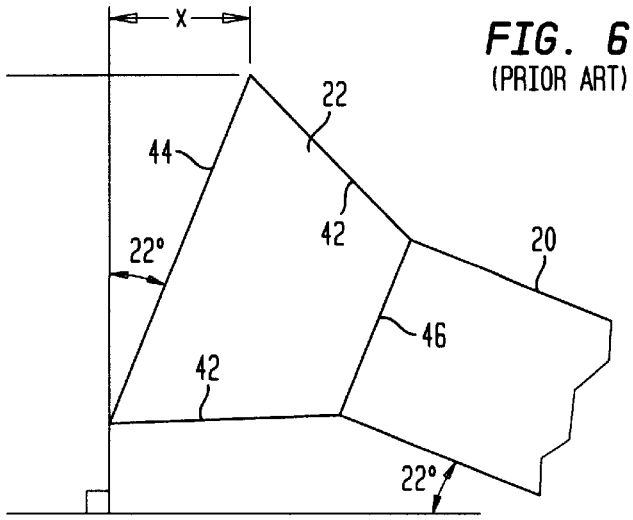
FIG. 6 (PRIOR ART)
FIG. 6 is an enlarged partial side elevational view of the entrance aperture and wire insertion hole of a prior art connector with the top section in its open position.

FIG. 6 depicts a prior art connector with the top section in its open position. The top section 12 generally pivots, by way of a non-limiting example, upwards about 22° about axis 32. The visibility of entrance aperture 22 can be calculated by measuring for distance x as shown in FIG. 6. One of skill in the art will recognize that x=Cosine 22°*0.143=0.054. Thus, about 0.054 inches of entrance aperture 22 can be seen from above when the prior art connector is in its open position, which is perceived as a flat ovoid. One of skill in the art will recognize that it is desirable to make the entrance apertures more visible to the user.

Figure 7:
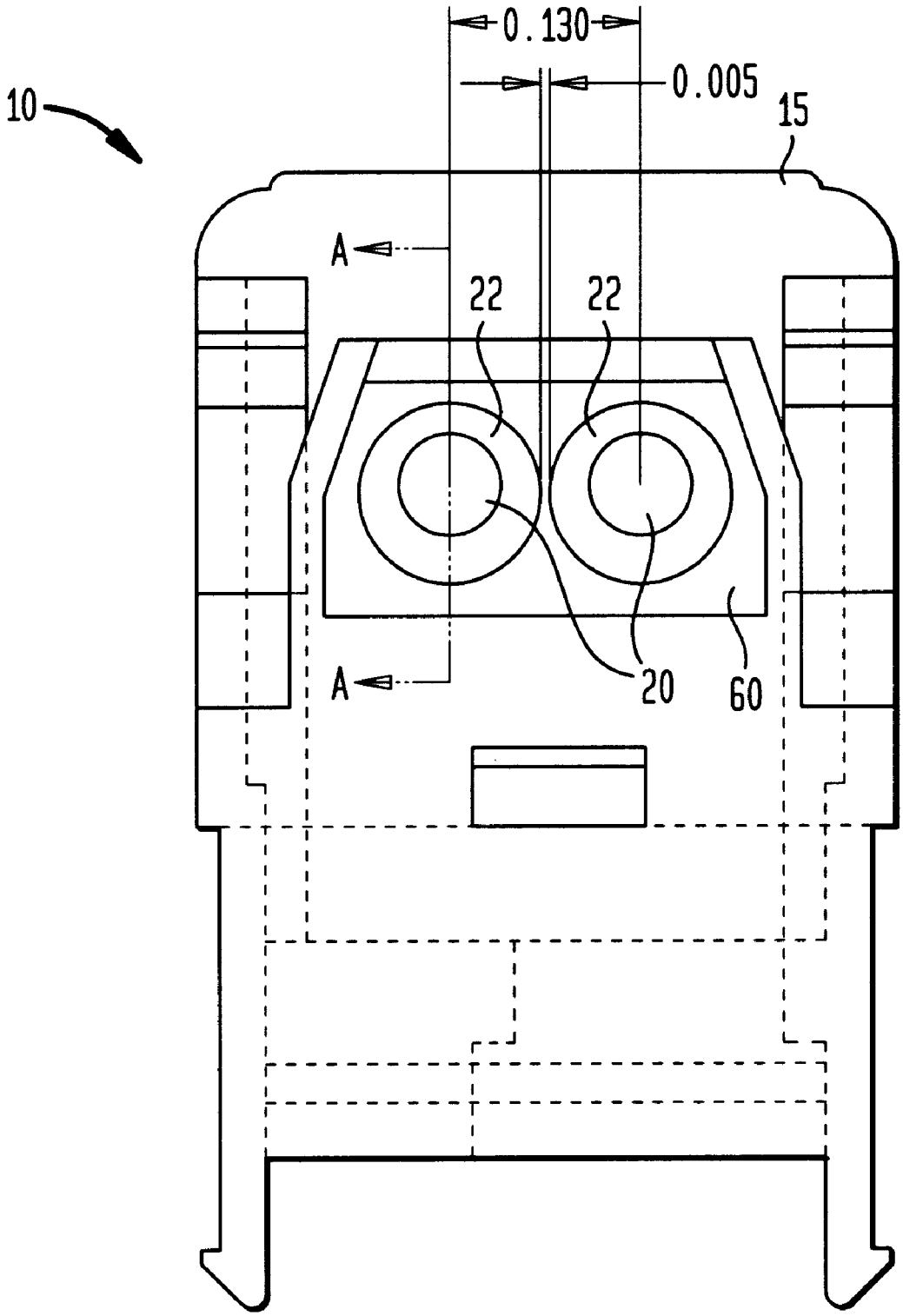
FIG. 7 is a front elevational view of a connector constructed in accordance with a preferred embodiment of the present invention with the top section in its closed and locked position.

The connector of the present invention is shown in FIGS. 7–12. As seen in FIGS. 7–10, a connector constructed in accordance with a preferred embodiment of the present invention, generally indicated as 10, has a top section, generally indicated as 12, having a front face 60 and a rear side 70, and is movable between a closed position (FIG. 8) and an open position (FIG. 9), and a bottom fixed section, generally indicated as 14. Connector 10 generally comprises two generally funnel-shaped, conical entrance apertures 22 formed in front face 60 which lead in tapered fashion to wire insertion holes 20. Wire insertion holes 20 have a longitudinal axis extending from front face 60 towards rear side 70. Front face 60 is generally a flat planar surface. As seen in FIG. 7, the centers of wire insertion holes 20 are about 0.130 inches apart, and there is about a 0.005 inch gap between the entrance apertures 22. Wire insertion holes 20 are constructed so as to accept wires 30. Connector 10 also has terminal strip receiving portions 26, which are constructed to accept terminal strips 28 when the top section 12 is in its closed position. Thus, as described more fully below, the connector of the present invention permits the distance between the centers of the wire insertion holes 20 to be decreased by about 0.13 inches, a potential 12% reduction in size, without having to overlap the entrance apertures 22.

Figure 8:
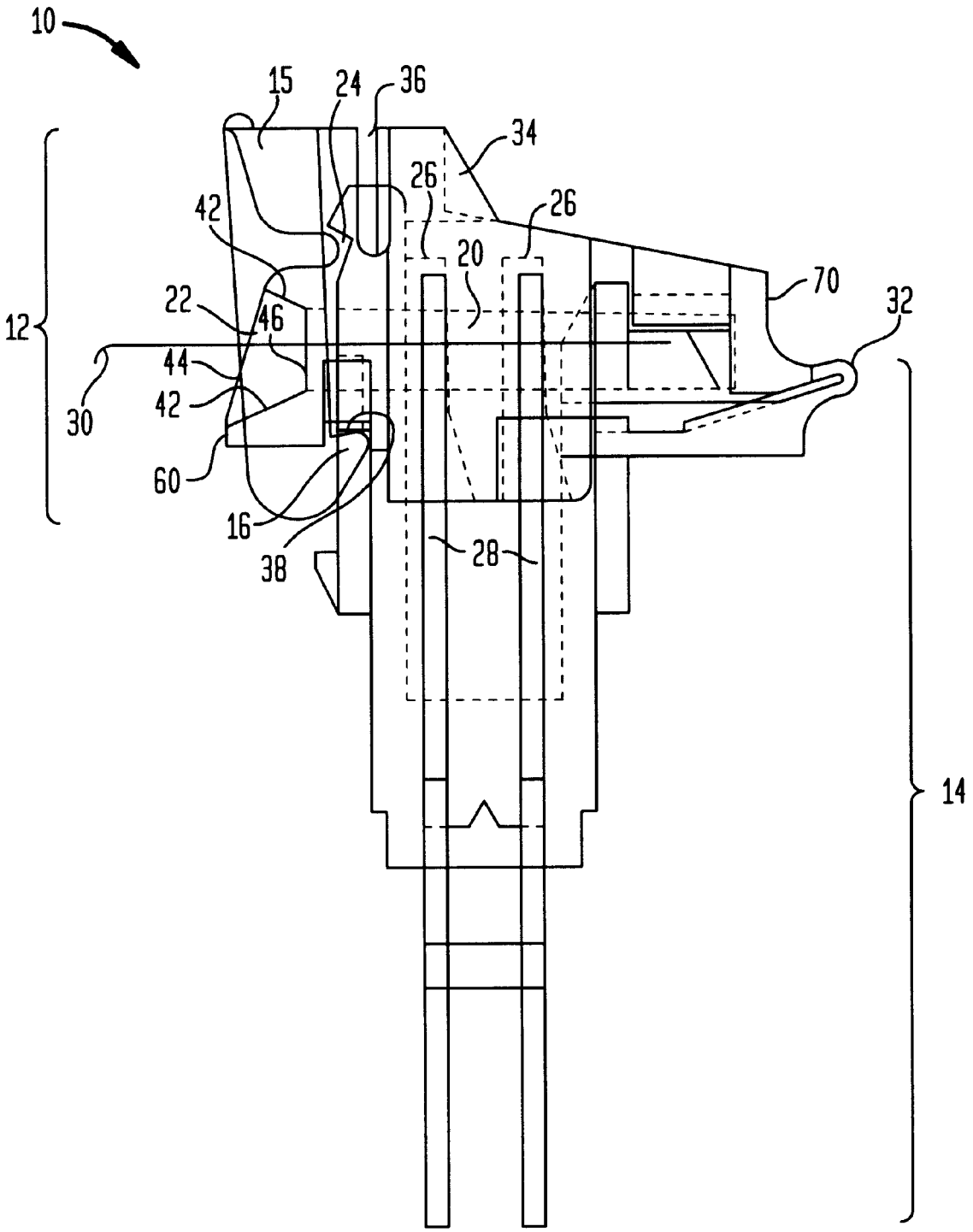
FIG. 8 is a side elevational view of the present invention connector of FIG. 7.

As seen in FIG. 8, when top section 12 is in its closed position, terminal strips 28 intersect wire insertion holes 20, and when top section 12 is in its open position (FIG. 9), terminal strips 28 do not intersect wire insertion holes 20. In order to establish an electrical and mechanical connection between the wires 30 and the terminal strips 28, a user first opens the top section 12, i.e., pivots top section 12 about hinged axis 32 to its open position, inserts pair of wires 30, and then closes the top section 12. Upon closing top section 12 of connector 10, wires 30 are brought into electrical and mechanical contact with terminal strips 28 in a manner known in the art. To remove the wires and/or break the electrical connection, the process is reversed.

Figure 9:
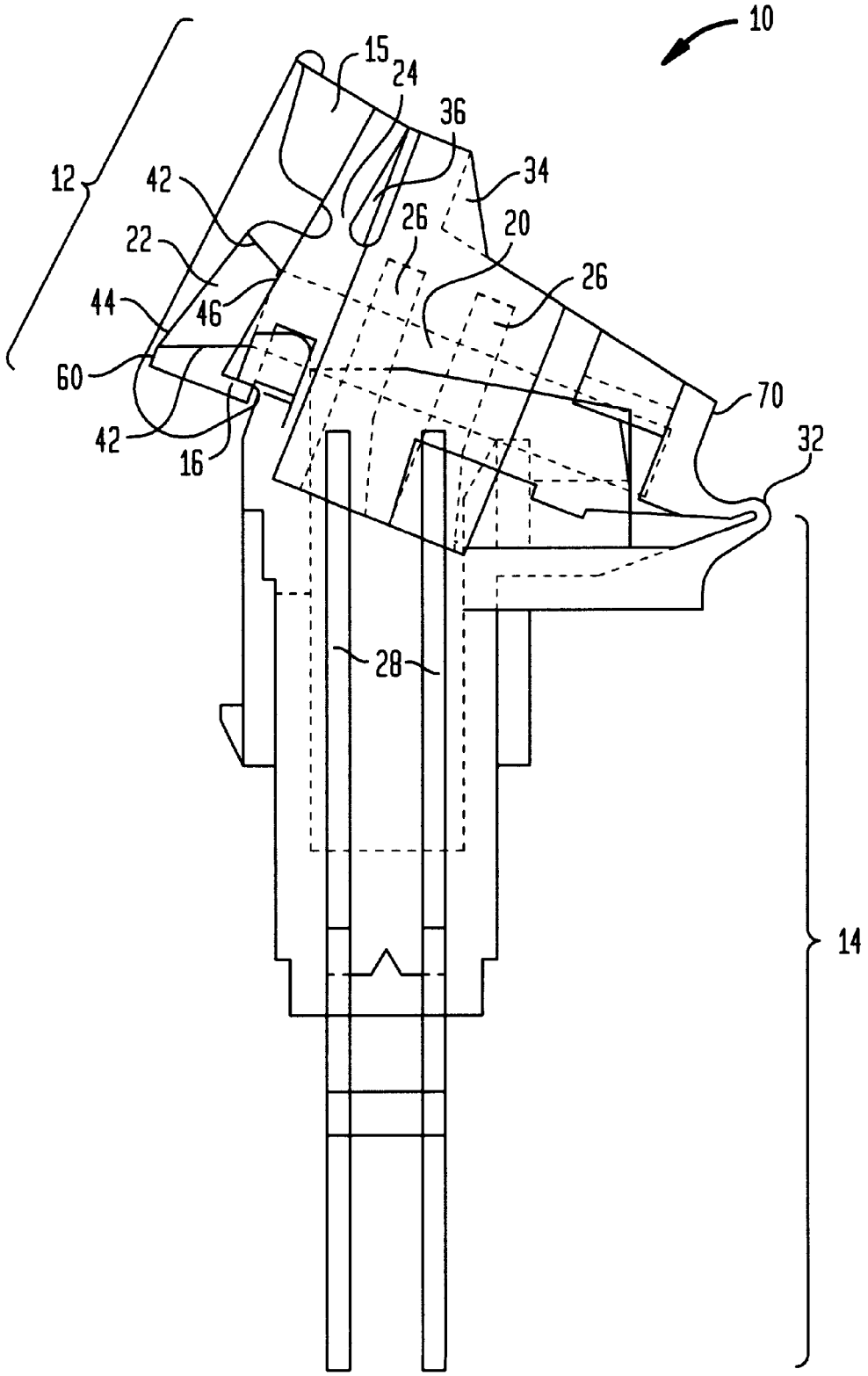
FIG. 9 is a side elevational view of the present invention connector of FIG. 7 with the top section in its open position.

As seen in FIG. 9, the top movable section 12 generally pivots about a hinged axis 32. The top section has a latch 15 movable between an engaged position and a disengaged position. As seen in FIG. 8, when top section 12 is in its closed position and the latch 15 is in its engaged position, latch engaging portion 16 engages latch retaining portion 38 on the bottom section 14 of the connector 10. Thus, when the top section 12 is in its closed position and the latch is in its engaged position, the latch 15 maintains top section 12 in its closed position. In order to open top section 12, latch 15 must first be moved to its disengaged position.

To move latch 15 between its engaged position and its disengaged position, a user generally grips the connector between a finger grip portion 34 and top portion of the latch 15. Upon squeezing or other pressure, latch 15 pivots about living hinge 24 towards recess 36. Latch 15 is pivoted about living hinge 24 into recess 36 a sufficient distance so as to disengage latch engaging portion 16 from latch retaining portion 38. Once latch engaging portion 16 is disengaged from latch retaining portion 38, top section 12 is able to move to its open position.

Figure 10:
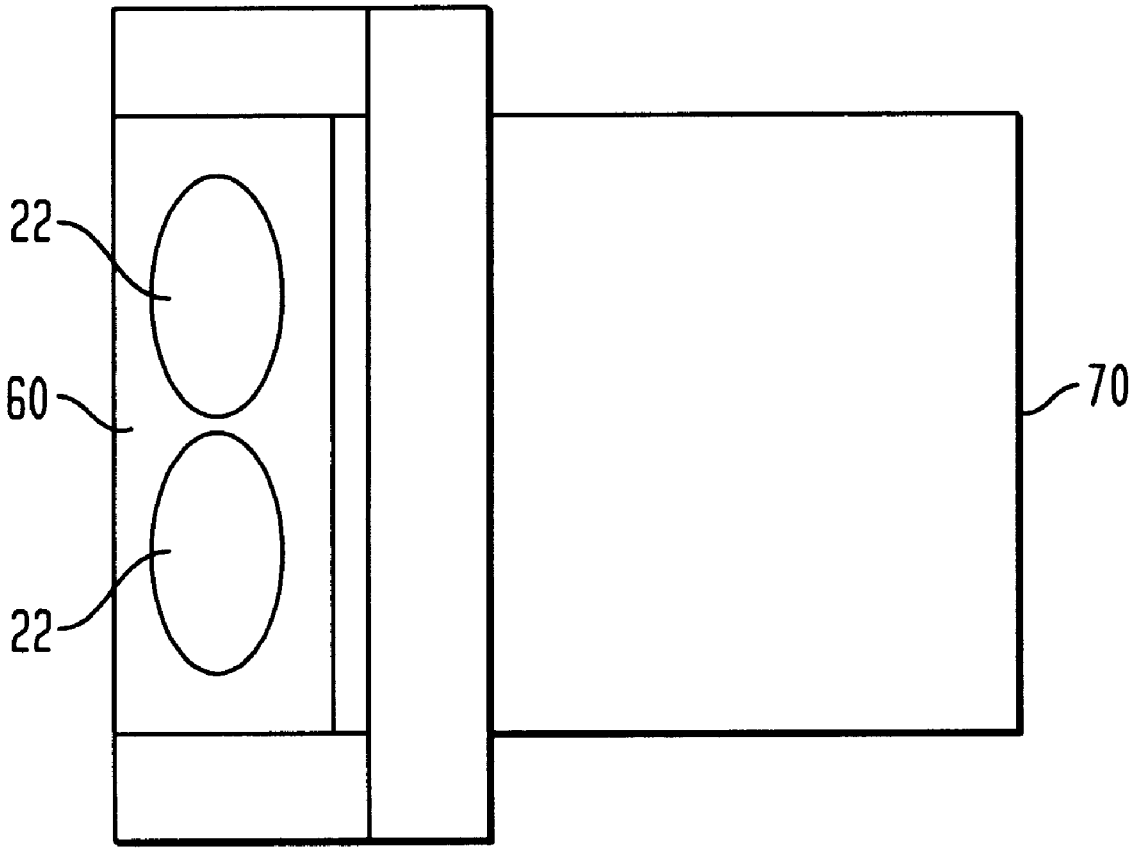
FIG. 10 is a top plan view of the present invention connector of FIG. 9.

As seen in FIG. 10, connector 10 is generally installed in a BEP (not shown) in a horizontal position. Yet even when the connector of the present invention is in its closed position, the entrance apertures 22 are visible, albeit they are perceived as smaller than when the connector is in its open position. The construction and visibility of the entrance apertures of the present invention connector is shown in more detail in FIGS. 11 and 12 and further described below.

Figure 11:
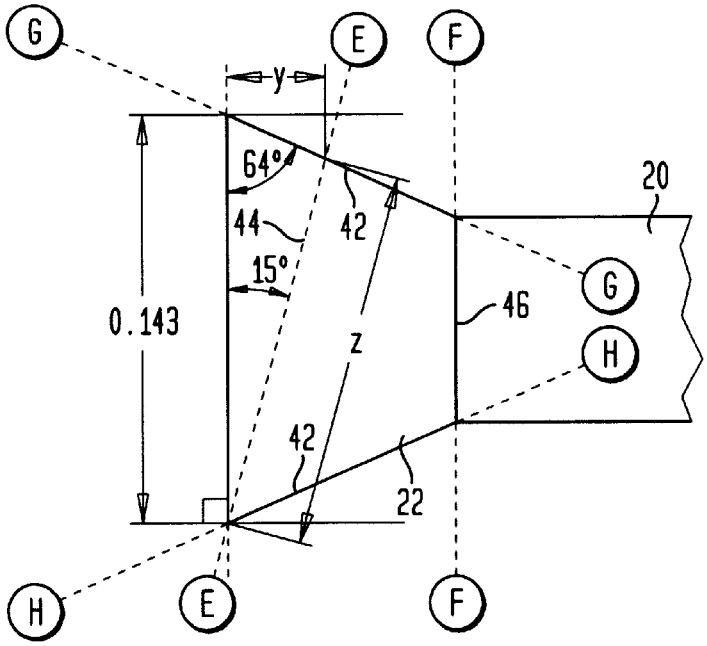
FIG. 11 is an enlarged partial side elevational view of the entrance aperture and wire insertion hole of a connector constructed in accordance with a preferred embodiment of the instant invention with the top section in its closed position.

FIG. 11 depicts a side sectional view taken along section A—A of FIG. 7, with a connector with the top section in its closed position, and having an entrance aperture constructed in accordance with a preferred embodiment of the present invention. By way of a non-limiting example, and in accordance with a preferred embodiment of the present invention, the top end of the entrance aperture of the present invention is angled, or cut away, at about a 15° angle. The entrance aperture 22 comprises an entrance opening 44, an exit opening 46, and side walls 42 extending between the two openings. When viewed in side sectional view, the entrance opening 44 forms a plane E, the exit opening 46 forms a plane F, and side walls 42 form planes G and H. Thus, when viewed from the side, the entrance aperture of the present invention forms a non-trapezoidal shape, or, in other words, no two planes of the entrance aperture of the present invention are parallel to one another. Also, when viewed from the side, the entrance opening 44 defines a first top edge where plane E meets plane G, and defines a first bottom edge where plane E meets plane H. When viewed from the side, exit opening 46 defines a second top edge where plane F meets plane G, and defines a second bottom edge where plane F meets plane H. As seen in FIG. 11, the distance between the first top edge and the second top edge is less than the distance between the first bottom edge and the second bottom edge.

As seen in FIG. 11, by way of a non-limiting example, the width or diameter z of the entrance opening 44 of entrance aperture 22 can be determined by the following formula: $z=d*\text{Sine } 64°/\text{Sine } (15°+64°)$, where d, by way of a non-limiting example, is the diameter of the prior art connector, 0.143 inches. Thus, z=0.131 inches. The side walls 42 of entrance aperture 22 are beveled at about a 25° angle towards wire insertion hole 20. One of skill in the art will recognize that when viewed from above, as in a typical installation, the entrance aperture 22 of the present invention can be seen. The visibility of entrance aperture 22 can be calculated by measuring for distance y as shown in FIG. 11. One of skill in the art will recognize that $y=\text{Sine } 15°*0.131=0.034$. Thus, about 0.034 inches of entrance aperture 22 can be seen from above when the connector of the present invention is in its closed position, as opposed to near zero for the prior art connector.

Figure 12:
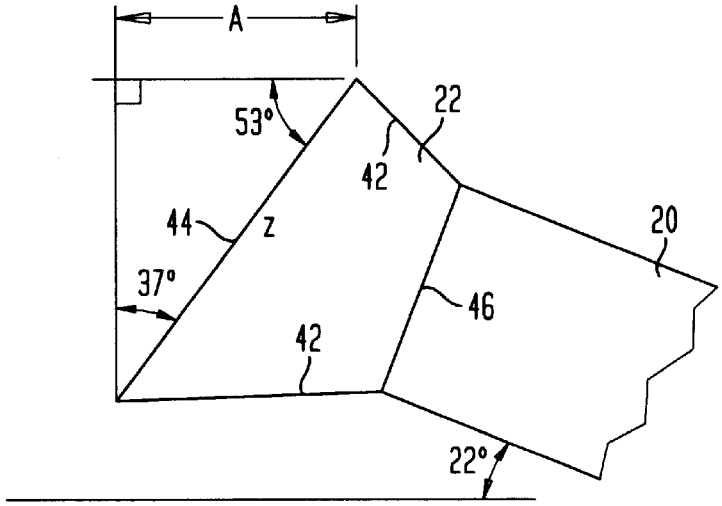
FIG. 12 is an enlarged partial side elevational view of the entrance aperture and wire insertion hole of a connector constructed in accordance with a preferred embodiment of the instant invention with the top section in its open position.

FIG. 12 depicts a side view of a connector with the top section in its open position, and having an entrance aperture constructed in accordance with a preferred embodiment of the present invention. The top section 12 generally pivots, by way of a non-limiting example, upwards about 22°. Thus, the visibility of entrance aperture 22 can be calculated by measuring for distance $\alpha$ as shown in FIG. 12. One of skill in the art will recognize that $\alpha=\text{Cosine } 53°*0.131=0.079$. Thus, about 0.079 inches of entrance aperture 22 can be seen from above when the connector of the present invention is in its open position, which is about a 46% increase over the prior art.

Connector 10 is preferably formed of a molded synthetic resinous material with good insulating properties and mechanical strength. The specific materials utilized in constructing connector 10 are an application specific matter of design choice within the knowledge of the person of skill familiar with terminal blocks utilized in the telephony art. Moreover, the specific means of affixing terminal strip 28 within connector 10 may be by snap fitting or by numerous methods of affixation known in the art, such as by way of non-limiting example, adhesives, friction fitting, integral molding, screws, and the like, depending on whether ready removal and re-insertion of the terminal is required, as a matter of application-specific design choice.

Terminal strips 28 may be formed of any commonly known electrically conductive metal or electrical conductor known in the art and suitable for use in such terminals, such as, for example, platinum-washed phosphor bronze, or beryllium-copper alloy or any other material, metal or alloy combining good electrical conductivity with sufficient mechanical strength and resilience.

Thus, the novel shape of the entrance apertures of the present invention permit the insertion holes to be moved closer together without having to overlap the entrance apertures. Further, the novel shape of the entrance apertures of the present invention permit greater visibility of the entrance apertures both when the connector is in its closed position and when the connector is in its open position. One of skill in the art will recognize that the actual angles and dimensions described herein can be varied, as a matter of design choice, without departing from the spirit of the invention. Thus, while the entrance aperture of the present invention has been described with preferred dimensions, the actual size of the openings, angles of beveling, and the like, can be varied as a matter of design choice.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A tool-less insulation displacement connector comprising:

a housing having an upper portion in which a wire insertion hole having a longitudinal axis is formed, said upper portion being pivotable between a closed position and an open position, said upper portion having a front face through which said axis extends; and an entrance aperture formed in said front face, said entrance aperture being in fluid communication with said hole, said front face having a generally flat planar surface, the surface plane of said front face intersecting said axis at a non-perpendicular angle such that said angled front face improves the visibility of said wire insertion hole when said upper portion is in both said closed position and said open position.

2. The connector according to claim 1, wherein said upper portion is movable between an open position and a closed position.

3. The connector according to claim 1, wherein said upper portion comprises a terminal strip receiving portion.

4. The connector according to claim 2, wherein said upper portion moves between said closed position and said open position about a living hinge.

5. The connector according to claim 1, further comprising a bottom section comprising a terminal strip.

6. The connector according to claim 5, wherein said terminal strip intersects said wire insertion hole when said upper section is in said closed position.

7. The connector according to claim 1, wherein said angle is about 15 degrees.

8. The connector according to claim 1, wherein said entrance aperture has a diameter of less than about 0.143 inches.

9. The connector according to claim 1, further comprising a second wire insertion hole having a second longitudinal axis extending through said front face; and said first longitudinal axis being spaced from said second longitudinal axis by less than about 0.148 inches.

10. The connector according to claim 1, wherein said connector is mounted to a connector block as part of an array of connectors.

11. The connector according to claim 10, wherein said connector block is mounted within a wiring junction box.

12. The connector according to claim 11, wherein said junction box is a building entrance protector.

13. The connector according to claim 11, wherein said junction box is a network interface unit.

14. A tool-less insulation displacement connector comprising:

a housing having a pivotable upper portion in which an entrance aperture is formed, said entrance aperture being in fluid communication with a wire insertion hole, said upper portion being pivotable between a closed position and an open position;

said upper portion having a front face through which said entrance aperture extends, and a rear side, said front face having a bottom edge, a top edge and two opposite sides;

said front face being sloped inward such that said bottom edge is farther from said rear side than is said top edge, said sloped front face improving the visibility of said entrance aperture when said upper portion is in both said closed position and said open position.

15. The connector according to claim 14, wherein said upper portion is movable between an open position and a closed position.

16. The connector according to claim 14, wherein said upper portion comprises a terminal strip receiving portion.

17. The connector according to claim 14, wherein said upper portion moves between said closed position and said open position about a living hinge proximate said rear side.

18. The connector according to claim 14, further comprising a lower portion comprising a terminal strip.

19. The connector according to claim 18, wherein said terminal strip intersects said wire insertion hole when said upper portion is in said closed position.

20. The connector according to claim 14, wherein said top edge is about 0.034 inches closer to said rear side than said bottom edge.

21. The connector according to claim 14, wherein said entrance aperture has a diameter of less than about 0.143 inches.

22. The connector according to claim 14, further comprising a second entrance aperture, said second entrance aperture being in fluid communication with a second wire insertion hole; and a center of said first wire insertion hole being spaced from a center of said second wire insertion hole by less than about 0.148 inches.

23. A tool-less insulation displacement connector comprising:

a pivotable top section having a front side and a rear side and having an entrance aperture having a first diameter and extending through said front side, and, when viewed from the side, said first diameter defining a first top edge and a first bottom edge, said top section being pivotable between a closed position and an open position;

said entrance aperture being in fluid communication with a wire insertion hole, said wire insertion hole having a second diameter, and, when viewed from the side, said second diameter defining a second top edge and a second bottom edge; and the distance between said first top edge and said second top edge being less than the distance between said first bottom edge and said second bottom edge, wherein the difference between the distance between said first top edge and said second top edge and the distance between said first bottom edge and said second bottom edge improves the visibility of said entrance aperture when said top section is in both said closed position and said open position.

* * * * *